US012171313B2

(12) United States Patent
Paumier et al.

(10) Patent No.: US 12,171,313 B2
(45) Date of Patent: Dec. 24, 2024

(54) PIECE OF JEWELLERY COMPRISING A CHAIN WITH CLIP(S) FOR MAKING A VERSATILE ADORNMENT

(71) Applicant: CHANEL, Neuilly-sur-Seine (FR)

(72) Inventors: Denis Paumier, Paris (FR); Laurent Laroche, Rebais (FR)

(73) Assignee: CHANEL, Neuilly-sur-Seine (FR)

( * ) Notice: Subject to any disclaimer, the term of this patent is extended or adjusted under 35 U.S.C. 154(b) by 0 days.

(21) Appl. No.: 17/791,935

(22) PCT Filed: Jan. 8, 2021

(86) PCT No.: PCT/EP2021/050273
§ 371 (c)(1),
(2) Date: Jul. 11, 2022

(87) PCT Pub. No.: WO2021/140200
PCT Pub. Date: Jul. 15, 2021

(65) Prior Publication Data
US 2023/0052864 A1 Feb. 16, 2023

(30) Foreign Application Priority Data
Jan. 10, 2020 (FR) ..... 2000216

(51) Int. Cl.
*A44C 5/00* (2006.01)
*A44C 5/20* (2006.01)
(Continued)

(52) U.S. Cl.
CPC ..... *A44C 5/20* (2013.01); *A44C 11/00* (2013.01); *A44C 13/00* (2013.01)

(58) Field of Classification Search
CPC ..... A44C 5/20; A44C 11/00; A44C 13/00; A44C 11/005; A44C 11/002; A44C 15/0045; A44B 15/005
See application file for complete search history.

(56) References Cited

U.S. PATENT DOCUMENTS 1,578,940 A * 3/1926 Wacha ..... A44C 5/209 24/518
3,094,754 A * 6/1963 Wayne ..... A44C 5/2038 104/5

(Continued)

FOREIGN PATENT DOCUMENTS

JP H07115 U1 1/1995
JP 2004290437 A 10/2004
WO 2015/054568 4/2015

OTHER PUBLICATIONS

International Search Report for PCT/EP2021/050273 dated Apr. 13, 2021, 8 pages.

(Continued)

*Primary Examiner* — Jack W Lavinder
(74) *Attorney, Agent, or Firm* — NIXON & VANDERHYE

(57) ABSTRACT

A piece of jewelry includes at least one chain having two ends, at least one of the two ends including a hollow clip fixed by a fixing device, the clip consisting of two half-shells, each half-shell including an extended edge delimiting a hollow internal space of the half-shell, the edges including notches into which the chain can be inserted, the half-shells being hinged together by an articulation between a closed position in which the two edges are brought together to close the clip and an open position in which the two edges are separated over at least part of their extents in order to allow a portion of the chain to be inserted between the two edges and through the internal space and so that the portion of the chain is retained in the clip by being blocked as to extraction and translation once the clip is closed.

20 Claims, 6 Drawing Sheets

(51) Int. Cl.
*A44C 11/00* (2006.01)
*A44C 13/00* (2006.01)

(56) References Cited

U.S. PATENT DOCUMENTS

| | | | | | |
|---|---|---|---|---|---|
| 3,114,187 | A | * | 12/1963 | Wayne | A44C 5/2038 63/3.1 |
| 3,181,217 | A | * | 5/1965 | Bohlinger | A44C 5/209 24/116 A |
| 4,480,589 | A | * | 11/1984 | Schneider | A01K 27/005 119/865 |
| 5,214,940 | A | | 6/1993 | Capifali | |
| 5,687,585 | A | * | 11/1997 | Ferrell | A44C 5/2095 24/116 A |
| 6,701,583 | B1 | | 3/2004 | McCullough | |
| 9,173,459 | B2 | * | 11/2015 | Gisser | A44C 5/2095 |
| 11,278,086 | B2 | * | 3/2022 | Walsh | A44C 5/18 |
| 2002/0066290 | A1 | * | 6/2002 | Chen | A44C 11/005 63/3 |
| 2002/0148251 | A1 | | 10/2002 | Plumly | |
| 2004/0194503 | A1 | * | 10/2004 | Schnitman | A44C 11/002 63/3.2 |
| 2015/0101364 | A1 | * | 4/2015 | Snow | A44C 5/20 63/23 |
| 2018/0103731 | A1 | | 4/2018 | Wong | |
| 2018/0360174 | A1 | | 12/2018 | Rohde | |

OTHER PUBLICATIONS

Written Opinion of the ISA for PCT/EP2021/050273 dated Apr. 13, 2021, 6 pages.

* cited by examiner

PIECE OF JEWELLERY COMPRISING A CHAIN WITH CLIP(S) FOR MAKING A VERSATILE ADORNMENT

CROSS-REFERENCE TO RELATED APPLICATIONS

This application is the U.S. national phase of International Application No. PCT/EP2021/050273 filed Jan. 8, 2021 which designated the U.S. and claims priority to French Patent Application No. 2000216 filed Jan. 10, 2020, the entire contents of each of which are hereby incorporated by reference.

BACKGROUND OF THE INVENTION

Field of the Invention

The present invention generally relates to the field of pieces of jewelry and, more particularly, relates to a piece of jewelry comprising a chain with clip(s) making it possible to produce several types of ornament. It is applied in particular in jewelry craftsmanship.

Description of the Related Art

In the field of jewelry, chain systems are known which make it possible to produce ornaments of various types by moving one or more fastening systems along the chains. However, the attachment systems are generally not aesthetic and, as a result, they have to be masked within decorations. In addition, they do not allow a large multitude of positions and therefore of shapes and uses. Since the attachment systems are generally made of two complementary parts having complementary decorations, it is generally not possible to move the attachment point. To circumvent this difficulty, it has been proposed to use "bare" fastening systems, without decoration, allowing great freedom of positioning and to cover them with independent and removable decorations which hide these fastening systems. This is for example the case in the documents WO2015/054568 A1 or U.S. Pat. No. 5,214,940 A. Such a solution, however, has problems and particularly the one that the decoration can be lost due to its removability. Further known are the documents US 2002/148251 A1, US 2018/360174 A1, US 2018/103731, and U.S. Pat. No. 6,701,583.

SUMMARY OF THE INVENTION

First of all, what is proposed according to the invention, is a piece of jewelry comprising at least one chain having two opposite ends, at least one of the two ends of the chain comprising a hollow clip fixed to said end by a fixing device, the chain being made up of links articulated together, the links being separated from each other by connections forming articulations between the links, said clip being made up of two half-shells, each half-shell comprising an extended edge delimiting a hollow internal space of the half-shell, at least one of the two edges comprising at least one notch defining a chain passage, the half-shells being hinged together by an articulation between a closed position in which the two respective edges of the two half-shells are brought together to close the clip, and an open position in which the two edges of the two half-shells are separated from each other over at least a part of their extent in order to allow a portion of the chain to be introduced between the two separate edges and through the internal space and so that the portion of the chain is retained in the clip by being blocked as to extraction and translation when the clip is in the closed position, the portion of the chain corresponding to a part of the chain which is gripped in the clip and which enters or leaves the clip through the chain passages, wherein the piece of jewelry has at least three notches, and wherein each link has a determined maximum transverse dimension, each connection has a determined maximum transverse dimension, and each chain passage, in the closed position of the clip, has a determined minimum transverse dimension and a determined maximum transverse dimension, the piece of jewelry being configured so that in the closed position of the clip, the minimum transverse dimension of the chain passage is substantially equal to the maximum transverse dimension of each connection and the maximum transverse dimension of the chain passage is less than the maximum transverse dimensions of the links, and wherein the clip is configured such that the closed position constitutes a rest position, the two respective edges of the two half-shells being constrained, by a resilient clipping device, to come together to close the clip, the open position having to be obtained by a manual action countering the action of the resilient clipping device.

Other non-limiting and advantageous characteristic features of the piece of jewelry according to the invention, taken individually or according to all the technically possible combinations, are the following:

- at least one of the two edges has at least one notch forming a chain passage and the chain can be inserted at least in part in said notch,
- the edge(s) has (have) two to six notches,
- the edge(s) has (have) four notches,
- the edge(s) has (have) three notches,
- when the two edges have notches, said notches are not opposite/facing each other between the two edges,
- the two edges have notches, said notches forming pairs of notches, the two notches of a pair being opposite each other on the two edges,
- the two edges have notches and the notches are arranged in pairs of notches, the two notches of a pair being opposite each other on the two edges, the two notches opposite a pair of 'notch defining a chain passage,
- the two edges have notches and the notches are arranged in pairs of notches, the two notches of a pair being opposite each other on the two edges, the two notches opposite a pair of notches defining a chain passage,
- the piece of jewelry has three pairs of notches or more than three pairs of notches,
- the portion of the chain enters and leaves the clip by two different sides of the clip,
- the portion of the chain enters and leaves the clip by two pairs of notches on two different sides of the clip,
- in the open position, the two half-shells are separated from each other on at least part of their edges in order to allow a portion of the chain to be introduced between the two edges and through the clip from a first side to another side of the clip,
- the clip is removable at the end of the chain,
- the removable clip can be moved along the chain and be fixed in predetermined locations or not,
- provision is made with the piece of jewelry for the further supply of at least one clip according to the invention, said at least one clip further provided being free and being able to be fixed along said at least one chain or to a free end of the chain,
- the clip is irremovable at the end of the chain,
- the clip attachment at the end of the chain has a swivel, the portion of the chain is also translationally blocked by the clip once the clip is in the closed position, the chain is flexible to match the shape of the part(s) of the body on which it rests, the chain is made up of links articulated together, the links are separated from each other by connections, the connections form articulations between the links, each link has a determined maximum transverse dimension, each link has a determined maximum transverse dimension and a determined minimum transverse dimension, in the closed position of the clip, the notches opposite a pair of notches define a chain passage of determined minimum transverse dimension and of determined maximum transverse dimension, for the closed position of the clip, the minimum transverse dimension of the chain passage is substantially equal to the maximum transverse dimension of each connection and the maximum transverse dimension of the chain passage is less than the maximum transverse dimensions of the links, the minimum transverse dimension of the chain passage is equal to the maximum transverse dimension of the chain passage, the maximum transverse dimension of the connection is equal to the minimum transverse dimension of the connection, the links are chosen from links with rotational symmetry, the links are chosen from spherical, oblong, ovoid links, each link has a circular cross-section with a determined maximum transverse diameter, each connection is substantially cylindrical in shape with a determined transverse diameter, in the closed position of the clip, the notches opposite a pair of notches define a chain passage of circular shape and of determined diameter, for the closed position of the clip, the diameter of the chain passage is substantially equal to the transverse diameter of each connection and the diameter of the chain passage is less than the maximum transverse diameters of the links, the links are hinged together by a swivel type connection, the links are chosen from rings, each ring delimiting a central through-hole, the rings are chained together, the crossing zone between two adjacent rings forming the connection, the links are solid parts hinged together, the chain results from braiding, the clip is configured in such a way that the closed position constitutes a rest position, the two respective edges of the two half-shells being constrained, by a resilient clipping device, to approach each other in order to close the clip, the open position having to be obtained by a manual action countering the action of the resilient clipping device, the clip is configured such that the open position constitutes a rest position, the two respective edges of the two half-shells being constrained, by a resilient opening device, to separate over at least part of their extents and open the clip, the closed position having to be obtained by a manual action countering the action of the resilient opening device, the two half-shells further comprising complementary closing locking means having to be unlocked to allow the opening of the clip, the closed position of the clip corresponds to bringing the two half-shells into contact with each other in an area where they were separated in the open position, the closed position of the clip corresponds to bringing the two edges of the half-shells into contact in an area where they were separated in the open position, the closed position of the clip corresponds to bringing the two edges of the half-shells into contact directly edge to edge in a zone where they were separated in the open position, the closed position of the clip corresponds to bringing the edge of one of the half-shells into contact with an element of the internal space of the other half-shell in a zone where they were separated in the open position, the two edges of the two half-shells are configured so that in the closed position, the two edges of the two half-shells are in contact with one another, in the closed position, the two edges are in contact with each other, the two edges being symmetrical with each other, the two edges of the two half-shells are configured so that in the closed position, one of the two half-shells which is the wider tops the other narrower half-shell, the edge of the narrower half-shell being able to enter the internal space of the wider half-shell, the two edges of the two half-shells are configured so that in the closed position, the two half-shells partly interpenetrate, the two edges overlapping in a parrot's beak, in the closed position, one of the two half-shells which is wider tops the other narrower half-shell, the narrower half-shell entering the internal space of the wider half-shell, the wider half-shell being capable of tilting and possibly moving, preferably without friction, on the outer surface of the narrowest half-shell when the clip is opened, in the closed position, the two half-shells partially interpenetrate, the two edges overlapping like a parrot's beak, one of the half-shells being able to tilt and possibly translate, preferably without friction, on the external surface of the other half-shell when opening the clip, the portion of the chain is also retained in translation once the clip is in the closed position by a resilient material placed inside the clip and intended to compress the portion of the chain introduced into the clip, once the clip is in the closed position, at least one of the half-shells internally comprises a resilient material which is compressible elastic foam made of synthetic material (plastic foam), each of the two half-shells has a resilient material inside which is compressible elastic foam made of synthetic material (plastic foam), the compressible elastic foam is intended to compress the portion of the chain introduced into the clip once the clip is in the closed position, the articulation between the two half-shells is arranged in a determined zone along or adjacent to the edges of said half-shells, the separation of the edges being obtained by tilting one half-shell relative to the other, causing an angular separation of the edges, the clip opening and closing like an oyster, for the clip opening and closing like an oyster, the articulation is straight, for the clip opening and closing like an oyster, the articulation is curved, for the clip opening and closing like an oyster, the articulation is punctual, when the clip opens like an oyster, the clip is configured in the shape of an oyster and has a pearl inside, said pearl being fixed to one of the half-shells, when the clip opens like an oyster, the opening or closing actions implement forces substantially perpendicular to the general planes of the half-shells, the articulation between the two half-shells is arranged in the center of the half-shells, an articulated arm being extended between the opposite centers of the two half-shells by crossing the two internal spaces, one of the two half-shells being wider and covering the other narrower half-shell so that the wider half-shell can tilt and possibly translate, preferably without friction, on part of the narrower half-shell when the clip opens, when the clip comprises an articulated arm between the two half-shells arranged in the center of the half-shells and opens by tilting and possibly by translation of one half-shell onto the other, the opening action implements a force substantially parallel to the general planes of the half-shells, the articulated arm comprises a resilient element bringing the clip back to the closed position in the absence of manual action, the articulated arm with resilient element is a spiral spring extended between the bottoms of the two half-shells, the articulated arm which is a spiral spring extended between the bottoms of the two half-shells allows the two half-shells to be separated from each other over at least part of their extents in any position on the periphery of the clip, the separation of the edges is obtained by sliding in translation of one half-shell on the other allowing parts of the edges to be uncovered, the half-shells remaining in parallel planes, the separation of the edges is obtained by sliding in rotation of one half-shell on the other, allowing parts of the edges to be uncovered, the half-shells remaining in parallel planes, the separation of the edges is obtained by linear sliding of a half-shell on the other allowing to discover parts of the edges, the two half-shells remaining in parallel planes during the opening, for the linear sliding of one half-shell on the other, one of the half-shells is guided sliding along a rail or a groove of the other half-shell, the two half-shells remaining in parallel planes when opening, the rail or the groove is straight, the rail or the groove is bypassed, the separation of the edges is obtained by sliding in rotation of a half-shell on the other allowing to discover parts of the edges, the articulation between the two half-shells is an articulation by linear and/or rotational sliding of one half-shell on the other, the two half-shells remaining in parallel planes during opening, said at least one chain comprises, at each of its two opposite ends, a clip, the piece of jewelry comprises a clip, the piece of jewelry comprises two clips, the piece of jewelry comprises more than two clips, one of the two half-shells is intended to be visible, the other half-shell being placed against the person wearing the piece of jewelry, at least the external surface of the visible half-shell being decorated, the decorated surface represents or stylizes in particular all or part of a plant or an animal, one of the two half-shells is intended to be visible, the other half-shell being placed against the person wearing the piece of jewelry, at least the external surface of the visible half-shell being shaped to represent or stylize a part plant or animal, one of the two half-shells is intended to be visible, the other half-shell being placed against the person wearing the piece of jewelry, at least the outer surface of the visible half-shell being shaped to represent or stylize an element, the element belongs to the animal or vegetable or astronomical reign, in particular a star, a planet or a comet, the two half-shells have decorated external surfaces, the decorated surface represents or stylizes in particular all or part of a plant or an animal, the two half-shells have external surfaces shaped to represent or stylize a part of a plant or an animal, the plant part is a flower bud, in particular of a *camellia,* the animal part is a part of an animal body, in particular an oyster shell, a turtle shell or an animal head, the two half-shells comprise complementary closing locking means which must be unlocked to open the clip.

The invention also relates to a method of implementing the piece of jewelry in which the portion(s) of chain(s) retained by the clip(s) are positioned to form at least one of: a long necklace, a double row long necklace, a double row necklace, a bracelet of at least three rows, typically of five rows, a pendant belt, an epaulette necklace, a Y necklace or a double Y necklace or according to any other possible configuration.

In a variant of the method, the same clip makes it possible to retain two distinct portions of the main chain by forming a chain loop between the two portions.

The invention also relates to a clip according to the description and in particular intended to be fixed to the end of a chain.

DESCRIPTION OF THE PREFERRED EMBODIMENTS

The following description with reference to the appended drawings, given by way of non-limiting examples, will make it clear what the invention consists of and how it can be implemented.

First of all, in the context of the invention, the term chain must be taken in a generic sense and covers any type of flexible linear continuous element, which can match the shape on which it is placed. The element constituting the chain can be single-stranded or multi-stranded. This element can be made up, over its length, of the same material, for example metal (typically meshes or rings) or of an assembly of materials together, for example metal+textile in wire or strip (for example a textile strip passed through the rings of a metal chain, a braiding) and/or assembled successively along the length of the element, for example metal at both ends and textile yarn or strip between the two. The metal is preferably a so-called "noble" metal, typically gold, silver and alloys. The element forming the chain can comprise along its length rigid parts but of reduced individual length to allow flexibility, for example mother-of-pearl, coral or glass beads to be able to form a necklace of pearls or coral whose element comprises a wire on which pearls are arranged at regular or irregular intervals. The chain can also be or include an optical fiber or a braiding of optical fibers.

The invention therefore implements at least one chain 1 comprising at least one clip 2 fixed to one end of a chain. In the examples shown, a single chain 1 is implemented, the two opposite ends of which each have a clip 2. The clip makes it possible to clip and retain a portion of the chain and is similar to a chain clasp except that this clasp does not act between the two ends of the chain but between one end and a portion of the chain between the two ends of the latter.

Figure 1:
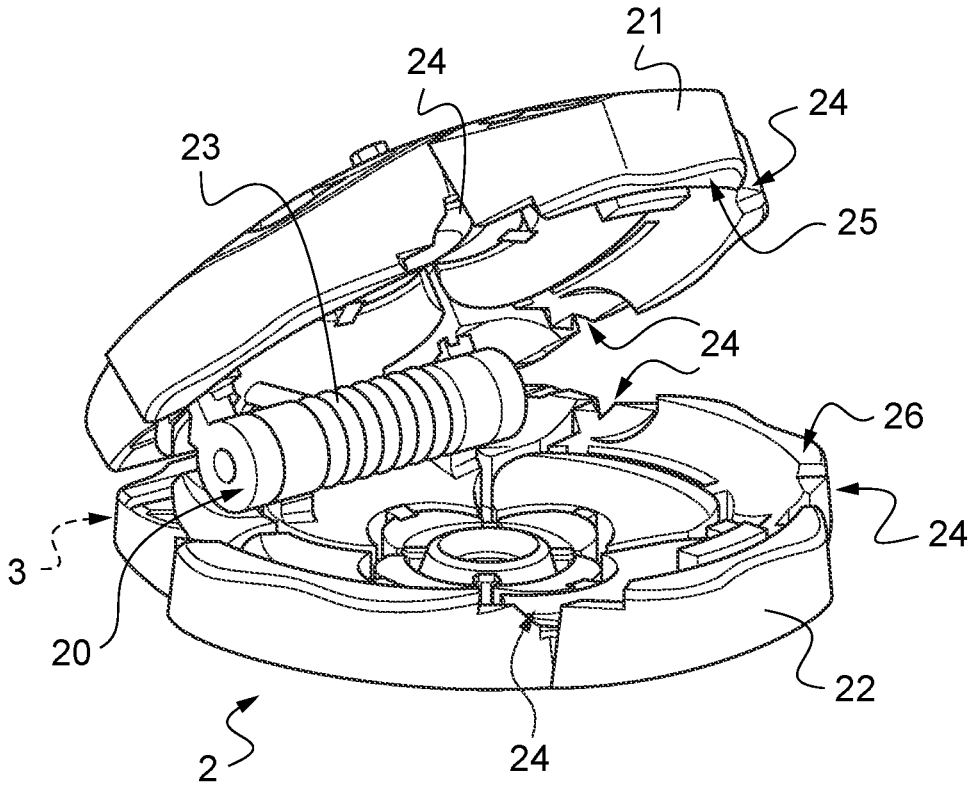
FIG. 1 shows a side perspective view of a clip in the open position.

In FIG. 1, the clip 2 which is internally hollow is in the open position. Clip 2 consists of two half-shells 21, 22, each half-shell 21, 22 comprising an edge 25, 26 delimiting a hollow internal space in each half-shell. The two half-shells 21, 22 are hinged together by a hinge 20 comprising a resilient clipping device which here is a spiral spring 23 forcing the clip to close.

In this example, the articulation arranged in the internal space has an axis of rotation that is parallel (horizontal when one of the half-shells is placed flat horizontally) to the general planes of the half-shells. Here, the articulation 20 is placed in the hollow internal space and offset towards the edges 25, 26.

In other embodiments, the articulation can be made on the edge 25, 26 or be arranged otherwise. For example, if the two half-shells have different widths, it is possible, with a spring placed centrally and extending (vertically when one of the half-shells is placed flat horizontally) between the centers of the bottoms of the two half-shells, to tilt and possibly translate the two half-shells between them to open the clip. The central spring can indeed bend laterally under the effect of a lateral thrust of one of the half-shells with respect to the other.

The open position of clip 2 is a forced position, since the rest position is the closed position of clip 2. In practice, to open the clip, it is necessary to apply a manual constraint to clip 2 so that the two half-shells 21, 22 diverge angularly from each other, here on a portion of their edges 25, 26. In this example, in the closed position of the clip 2, the two edges 25, 26 substantially come into contact with each other. In other embodiments, the half-shells can be of different widths or diameters and one half-shell can partly fit into the other by tilting and can possibly translate there.

In a variant embodiment in which the two half-shells comprise complementary closing locking means which must be unlocked to open the clip, the open position of the clip is the rest position, that is to say that the two half-shells are forced by a resilient opening device to open when the complementary locking means are unlocked, the closing of the clip requiring a manual action to bring the two half-shells closer together and lock the complementary locking means. The resilient opening device can also be a spiral spring, this time forcing the clip open and being arranged along the articulation 20 similar to that of FIG. 1.

In the clip of FIG. 1, the separation of the edges is obtained by tilting off one half-shell relative to the other causing an angular spacing of the edges in the manner of the opening of an oyster. In other embodiments, with an articulation arranged differently, the separation of the edges can be obtained by tilting and translation of one half-shell relative to the other also causing an angular separation of the edges and a possible translation. For example, with one of the half-shells narrower than the other, a spiral spring can be installed between the centers of the two half-shells, inside the clip, so that the wider one can tilt and possibly translate on the other (the centers of the two hemispheres shifting).

Other articulation systems are possible to separate the edges and open the clip, in particular by sliding one half-shell on the other, both remaining in planes parallel to each other unlike the previous cases where there is angular tilting.

Figure 2:
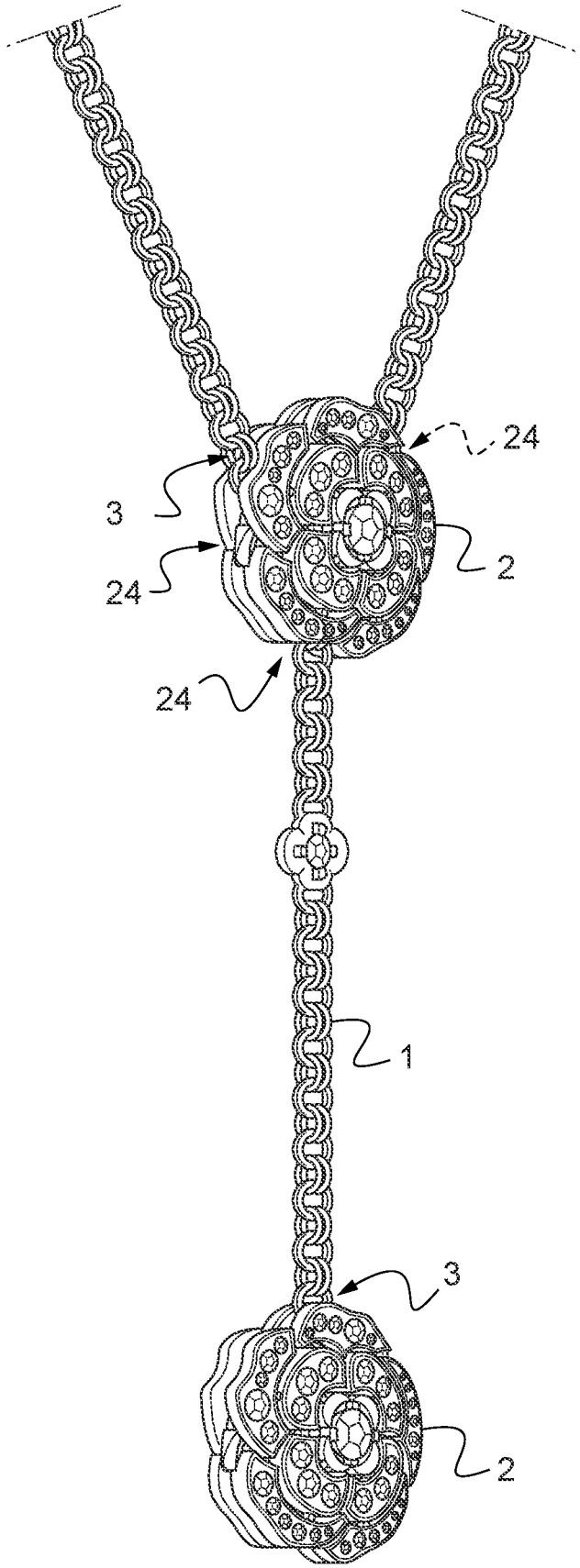
FIG. 2 shows a perspective view of a piece of jewelry consisting of a chain with two opposite ends each comprising a clip, one of the clips retaining a portion of the chain to form a Y-shaped necklace.

The chain (not shown in FIG. 1) is fixed to one of the half-shells towards the rear of the articulation 20 by a fixing device 3 which, therefore, is not visible in FIG. 1 due to the orientation of the clip 2 On the other hand, in FIG. 2, the fixing devices 3 for fixing each of the two ends of chain 1 to the corresponding clip 2 are shown.

The edges 25, 26 of the half-shells have notches 24 which face each other, two by two, in pairs, when the clip is closed. A larger chain passage is thus obtained compared to the case of non-facing notches, but the size of the facing or non-facing notches can be adapted to the needs. The notches correspond to sides of the clip through which a portion of the chain can enter or leave the clip. A portion of the chain corresponds to a part of the chain 1 which is clipped/caught in the clip 2. The concept of entry and exit of portion of the chain is arbitrary, a portion of the chain has two ends and a first end can arbitrarily match an input and the other will then match an output. Furthermore, this notion of entry and exit is unrelated to the way in which the chain is inserted into the clip: the chain is not threaded into the notches. To insert the portion of the chain into the clip, the clip is opened, the portion of the chain is placed on one of the half-shells and so that it passes through the notch(es) chosen according to the adornment to be made and the clip is closed. Since each notch in the case of notches without vis-à-vis or each pair of notches has a size adjusted to the size of the connection between links in the closed position of the clip, the positions of the notches on the edges of the half-shells, the hollow space available in the half-shells and the distance between the links along the chain are such that once the portion of the chain is taken inside the closed clip, the links which are positioned/located at the notches so that the clip is effectively closed. Since the links of the chain are articulated to each other and since a certain longitudinal play (along the chain) may also exist, obtaining the positioning of the links at the level of the notches in the closed position of the clip is relatively easy. More generally, the links of the pinched portion of the chain are not tightened by hard parts of the interior of the half-shells and, by construction as explained above, not tightened by the notches, in order to avoid marking of their surfaces. In addition, due to the adjustment between the sizes of the link and of the chain passage formed by each notch, the tightening of the clip against the links by and at the notches is carried out with a reduced pressure, always in order to avoid marking the surface of the connection. The shape of the notches can also be adapted to the shape of the connection. For example, if the link is of substantially cylindrical shape, the single notch or the pair of notches forming the chain passage has a cylindrical shape and the diameters of the passages are adjusted to the diameters of the connections. More generally, the shape of the chain passage can correspond to an imprint of the shape of the connection, which can also allow the connection to be locked in rotation if the connection has flat surface parts.

The chain can therefore be inserted into these notches in such a way that the portion of the chain can be caught in the hollow internal space of the clip and the clip can close with the portion of the chain caught inside the clip 2. Once the portion of the chain has been gripped by the clip, this portion is retained as to extraction and translation/sliding and possibly rotation: the portion of the chain is completely immobilized in the clip because the connections of reduced size compared to the links are taken in the pairs of notches whose passage dimensions are adjusted to the dimensions of the connections and because the shape of the passage is an imprint of the shape of the connection.

In a variant concerning a chain with links, the passage dimensions of the notches are adjusted to the dimensions of the links passing flat in the notches and the shape of the passage is an imprint of the external shape of the link. It is understood that in this variant, the connection which is of smaller dimension can also pass through the notch but since the adjacent links are substantially perpendicular to each other, there is indeed a blocking of the portion of the chain in the clip.

In this embodiment, three pairs of notches 24 are made along the edges 25, 26.

The half-shells can have any useful and decorative shape.

The outer faces of the half-shells may comprise decorative motifs and, possibly, inserts including precious or semi-precious stones, or even simply decorative. In FIG. 2, we see more specifically the decorative patterns of the clip 2 which stylize a *camellia* flower bud with stone parts and metal parts.

The chain in FIG. 2 has a clip at each of its two ends. Clip 2 at the bottom of FIG. 2 forms a simple pendant and is not used to retain a portion of the chain. On the other hand, the clip 2 at the top of FIG. 2 served to clip a portion of the chain, hence the Y-shaped structure of the assembly. For this clip 2 at the top of FIG. 2, the portion of the chain enters on one side of the clip and leaves on another side of the clip.

It is also contemplated to configure the clip to allow the clip to clip several portions of chain.

Since there is a hollow internal space in the clip, it is envisaged to install a resilient material therein, for example a synthetic foam, serving to compress the portion of the chain and to improve its retention in the clip. In particular, if the internal space is large enough, it is envisaged to store therein a very long portion of the chain by folding it back on itself to reduce the apparent length of the adornment.

Since there is a hollow internal space in the clip, it is planned to install a porous material or material that can soak and in which you can put a few drops of a perfume compatible with the materials of the adornment, the material being possibly removable.

Since there is a hollow internal space in the clip, it is envisaged to reserve a part of it for installing electronic equipment. For example, an LED light source for illuminating the stones of the half-shell(s) from the inside and/or for illuminating the core of one or more optical fibers belonging to the chain (for example the ends of the fibers, which are at the end of the chain attached to the clip, could enter the clip to catch the light there). Notches can be made along the optical fiber to form more or less punctual light sources along the chain and for possibly illuminating from the inside a pearl or another decorative element placed along the chain.

As an example of how the piece of jewelry can be implemented as an adornment, FIGS. 3 to 10 show various possibilities for attaching the clips of a single-strand chain comprising a clip at each one of both ends. As can be seen, the chain can be worn around the neck, wrist or waist.

Figure 3:
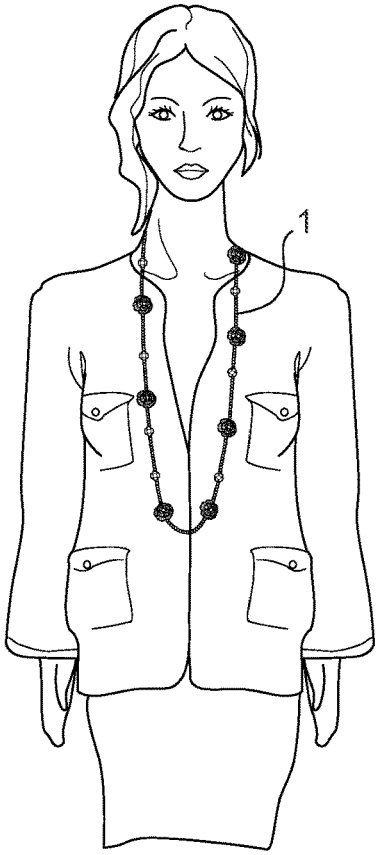
FIG. 3 represents an example of implementation of the piece of jewelry consisting of a chain with two opposite ends each comprising a clip to form a long necklace.

In FIG. 3, a very long necklace is made, the clip of a first end of the chain being hooked close to its second end.

Figure 4:
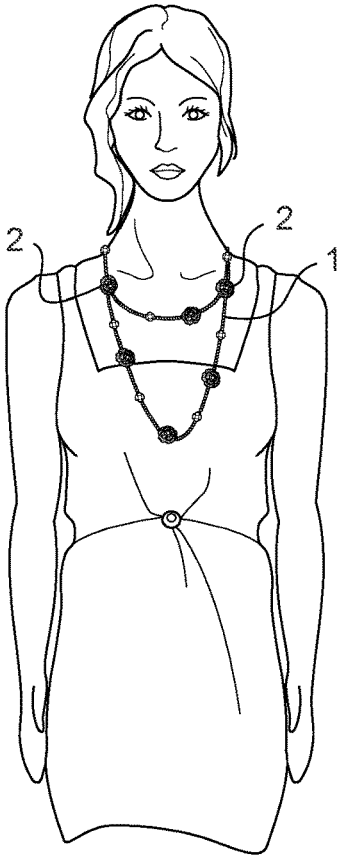
FIG. 4 shows an example of implementation of the piece of jewelry consisting of a chain with two opposite ends each comprising a clip to form a double row long necklace.
Figure 5:
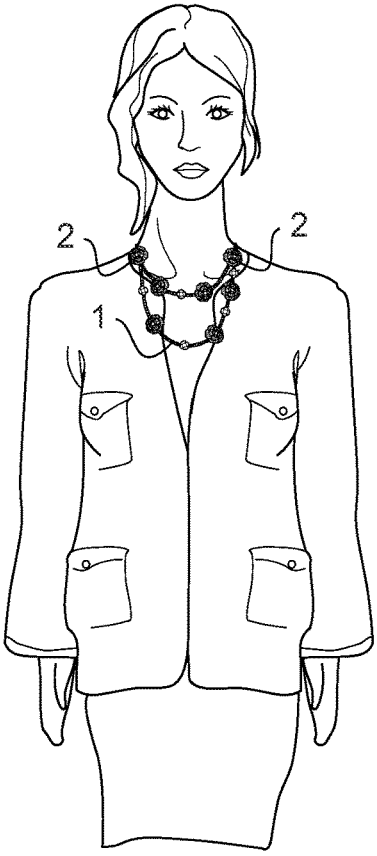
FIG. 5 shows an example of implementation of the jewelry piece consisting of a chain with two opposite ends each comprising a clip to form a double row necklace.

In FIGS. 4 and 5, a double row of the long necklace or necklace type is produced by hooking the two clips at two different points along the chain.

Figure 6:
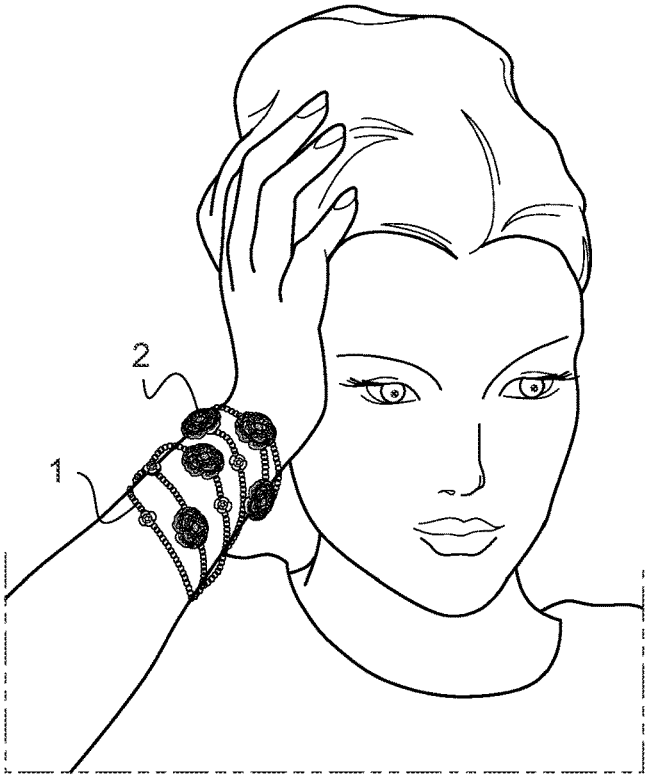
FIG. 6 represents an example of implementation of the piece of jewelry consisting of a chain with two opposite ends each comprising a clip to form a five-row bracelet.

In FIG. 6, a five-row bracelet is made. For a bracelet, one or both clips can be used to hook the chain.

Figure 7:
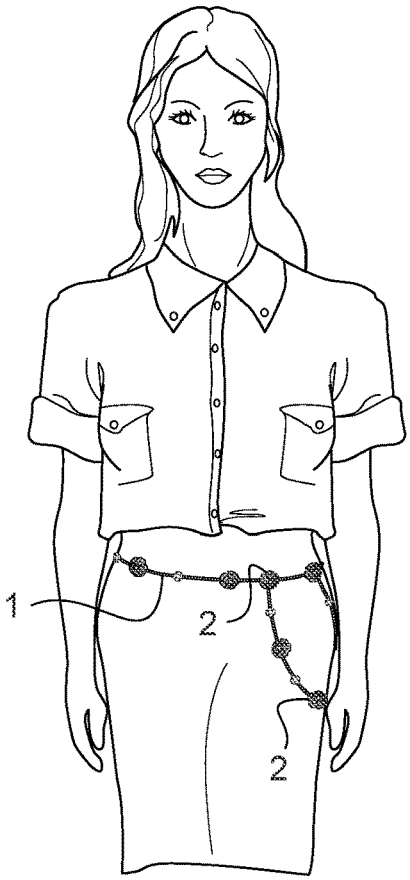
FIG. 7 represents an example of implementation of the piece of jewelry consisting of a chain with two opposite ends each comprising a clip to form a belt.

In FIG. 7, a pendant belt is made pendant where a single clip is used for attachment.

Figure 8:
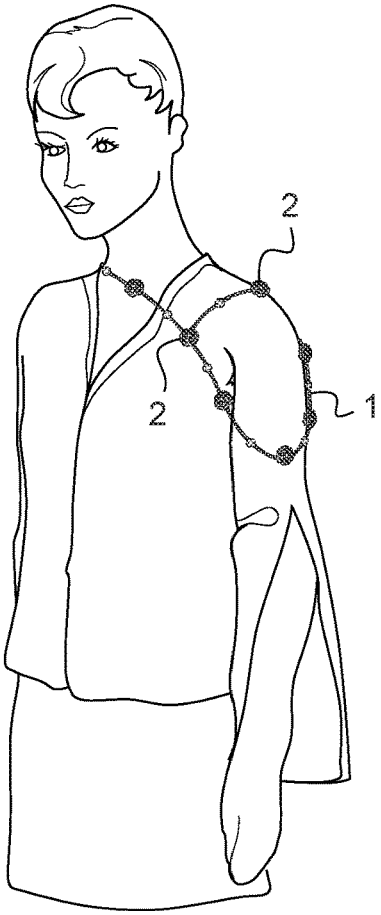
FIG. 8 represents an example of implementation of the piece of jewelry consisting of a chain with two opposite ends each comprising a clip to form an epaulette.

In FIG. 8, an epaulet necklace is made which is similar in its construction to the double-row necklace in FIG. 4.

Figure 9:
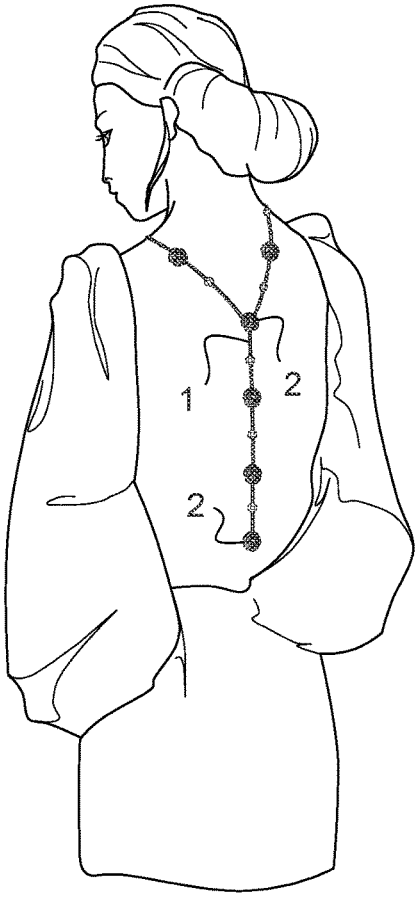
FIG. 9 represents an example of implementation of the piece of jewelry consisting of a chain with two opposite ends each comprising a clip to form a Y necklace.

In FIG. 9, a Y collar is produced, the clip of a first end of the chain being attached at a distance from the second end of the chain.

Figure 10:
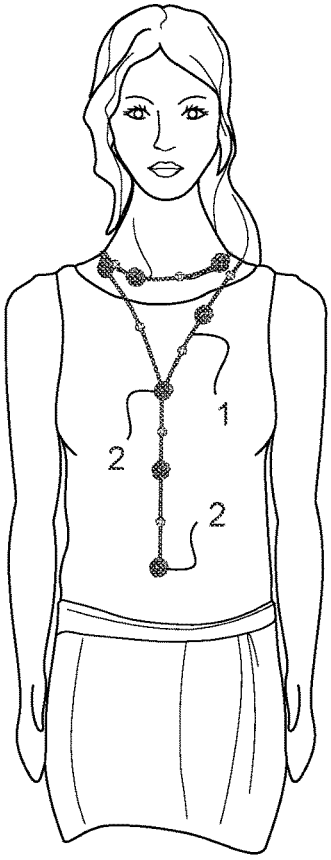
FIG. 10 represents an example of implementation of the piece of jewelry consisting of a chain with two opposite ends each comprising a clip to form a double Y necklace.
Figure 11:
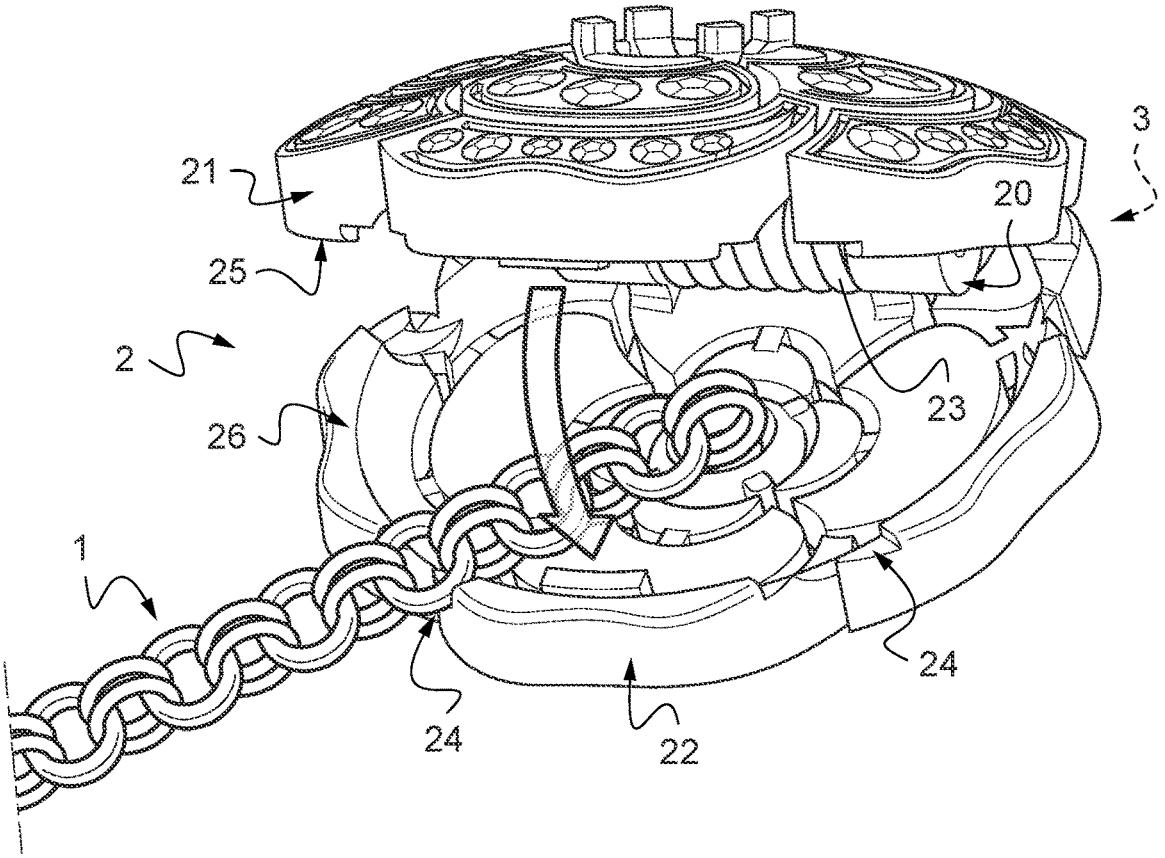
FIG. 11 represents a perspective view of the clip and chain, the clip being on the verge of being closed to retain the chain.
Figure 12:
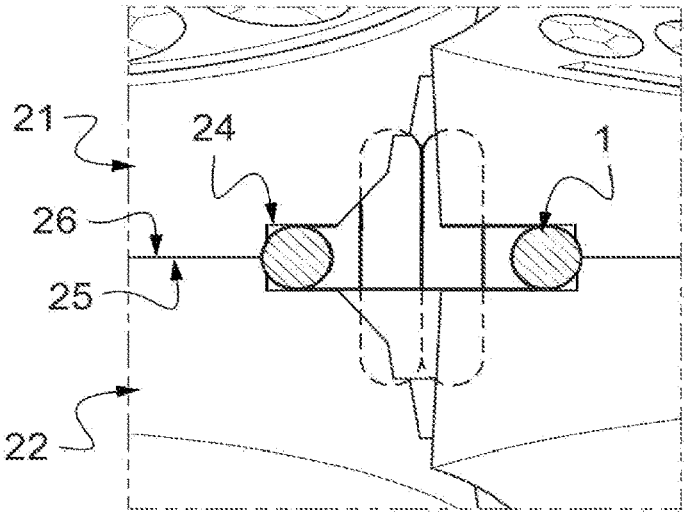
FIG. 12 represents an enlarged view in section of the clip and chain in a chain passage area.

In FIG. 10, a double Y collar is produced, derived from the Y collar of FIG. 9 for its production by a double passage around the neck.

It is well understood that it is possible to produce other types of adornment depending on the number of clips used for attaching the chain and on the attachment location(s) along the chain.

In a more general manner, the retained portion of the chain(s) and the clip(s) are freely positioned according to the needs, desires and/or morphology of the person wearing the piece of jewelry, resulting in great adaptability.

In addition, the fact has been shown that each clip hooks a single portion of the chain, but it is also possible that the same clip can hook two, or even more, portions of chain, particularly when the diameter of the chain and the size of the clip allow it.

Finally, preferably, the clip(s) are fixed in a non-removable manner to/at the ends of the chain and provision is made for the supply with the piece of jewelry or independently thereof, of additional clips which can be fixed along said at least one chain or at a free end of the chain to further increase versatility.

The invention claimed is:

1. A piece of jewelry comprising at least one chain having two opposite ends, at least one of the two opposite ends of the chain comprising a hollow clip fixed removably or irremovably to said at least one of the two opposite ends by a fixing device, the chain being made up of links articulated together, the links being separated from each other by connections forming articulations between the links, said hollow clip being made up of two half-shells, each half-shell comprising an edge extent, forming two edges of said hollow clip, one on each half shell, each of the two edges delimiting a hollow internal space of the half-shell, each of the two edges comprising at least three notches, said at least three notches on a first of the two edges being opposite to and facing said at least three notches on a second of the two edges, each opposite and facing notches form a pair of notches defining a chain passage, the half-shells being hinged together by a hinge between a closed position in which the two respective edges of the two half-shells are brought together to close the hollow clip and an open position in which the two edges of the two half-shells are separated from each other over at least part of the edge extents of the two edges in order to allow a portion of the chain to be introduced between the two edges and through the hollow internal space and so that the portion of the chain is retained in the hollow clip by being blocked as to extraction and translation when the hollow clip is in the closed position, the portion of the chain corresponding to a part of the chain which is gripped in the hollow clip and which enters or leaves the hollow clip through the chain passage, wherein each link has a determined maximum transverse dimension, each connection has a determined maximum transverse dimension, and in the closed position of the hollow clip, the chain passage has a determined minimum transverse dimension and a determined maximum transverse dimension, the piece of jewelry being configured so that in the closed position of the hollow clip, the minimum transverse dimension of the chain passage is substantially equal to the maximum transverse dimension of each connection and the maximum transverse dimension of the chain passage is less than the maximum transverse dimensions of the links, and wherein the hollow clip is configured such that the closed position constitutes a rest position, the two respective edges of the two half-shells being constrained by a resilient clipping device for closing the hollow clip, the open position having to be obtained by a manual action countering an action of the resilient clipping device.

2. The piece of jewelry according to claim 1, wherein the links are chosen: either from links with rotational symmetry and each link is of substantially central shape with a determined transverse diameter, or from rings, each ring defining a central through-hole.

3. The piece of jewelry of claim 2, wherein the closed position of the hollow clip corresponds to bringing the two half-shells into contact with each other in a zone where the two half-shells were separated from one another in the open position.

4. The piece of jewelry of claim 2, wherein the two edges are configured so that, in the closed position, the two edges are in contact with each other.

5. The piece of jewelry of claim 2, wherein the hinge between the two half-shells is arranged in a determined area along or adjacent to the two edges, a separation of the two edges being obtained by tilting a first of the two half-shells relative to a second of the two half shells and causing an angular separation of the edges.

6. The piece of jewelry according to claim 2, wherein said hollow clip has an external surface defined by an outer surface of each of the two half-shells with the outer surface of one of the two half-shells being placed against a wearer of the piece of jewelry and the outer surface of the other of the two half-shells facing away from the wearer of the piece of jewelry and being visible and shaped to represent or stylize an element.

7. The piece of jewelry according to claim 1, wherein the closed position of the hollow clip corresponds to bringing the two half-shells into contact with each other in a zone where the two half-shells were separated from one another in the open position.

8. The piece of jewelry of claim 7, wherein the links are chosen: either from links with rotational symmetry and each link is of substantially central shape with a determined transverse diameter, or from rings, each ring defining a central through-hole.

9. The piece of jewelry of claim 7, wherein the two edges are configured so that, in the closed position, the two edges are in contact with each other.

10. The piece of jewelry of claim 7, wherein the hinge between the two half-shells is arranged in a determined area along or adjacent to the two edges, a separation of the two edges being obtained by tilting a first of the two half-shells relative to a second of the two half shells and causing an angular separation of the edges.

11. The piece of jewelry according to claim 1, wherein the two edges of the two half-shells are configured so that, in the closed position, the two edges of the two half-shells are in contact with each other.

12. The piece of jewelry of claim 11, wherein the links are chosen: either from links with rotational symmetry and each link is of substantially central shape with a determined transverse diameter, or from rings, each ring defining a central through-hole.

13. The piece of jewelry of claim 11, wherein the hinge between the two half-shells is arranged in a determined area along or adjacent to the two edges, a separation of the two edges being obtained by tilting a first of the two half-shells relative to a second of the two half shells and causing an angular separation of the edges.

14. The piece of jewelry according to claim 13, wherein said hollow clip has an external surface defined by an outer surface of each of the two half-shells with the outer surface of one of the two half-shells being placed against a wearer of the piece of jewelry and the outer surface of the other of the two half-shells facing away from the wearer of the piece of jewelry and being visible and shaped to represent or stylize an element.

15. The piece of jewelry according to claim 1, wherein the hinge between the two half-shells is arranged in a determined area along or adjacent to the two edges of said half-shells, a separation of the two edges being obtained by tilting one half-shell relative to the other and causing an angular separation of the two edges.

16. The piece of jewelry according to claim 1, wherein the chain comprises an additional hollow clip, the piece of jewelry comprising two hollow clips, the two hollow clips being at each one of the two opposite ends of the chain.

17. The piece of jewelry according to claim 1, wherein the hollow clip is fixed irremovably at the end of the chain.

18. The piece of jewelry according to claim 1, wherein said hollow clip has an external surface defined by an outer surface of each of the two half-shells with the outer surface of one of the two half-shells being placed against a wearer of the piece of jewelry and the outer surface of the other of the two half-shells facing away from the wearer of the piece of jewelry and being visible and shaped to represent or stylize an element.

19. The piece of jewelry of claim 12, wherein the two edges are configured so that, in the closed position, the two edges are in contact with each other.

20. The piece of jewelry of claim 1, wherein the hinge between the two half-shells is arranged in a determined area along or adjacent to the two edges, a separation of the two edges being obtained by tilting a first of the two half-shells relative to a second of the two half-shells and causing an angular separation of the edges.

* * * * *